US010603898B2

(12) United States Patent
Imai et al.

(10) Patent No.: US 10,603,898 B2
(45) Date of Patent: Mar. 31, 2020

(54) INK JET RECORDING METHOD AND INK JET RECORDING APPARATUS

(71) Applicant: CANON KABUSHIKI KAISHA, Tokyo (JP)

(72) Inventors: Takashi Imai, Kawasaki (JP); Futoshi Hirose, Yokohama (JP); Susumu Hirosawa, Tokyo (JP); Atsushi Sakamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/033,399

(22) Filed: Jul. 12, 2018

(65) Prior Publication Data

US 2019/0016116 A1 Jan. 17, 2019

(30) Foreign Application Priority Data

Jul. 14, 2017 (JP) ..... 2017-137620
Jun. 19, 2018 (JP) ..... 2018-115730

(51) Int. Cl.

| | |
|---|---|
| ***B41J 2/005*** | (2006.01) |
| ***B41J 29/17*** | (2006.01) |
| ***B41M 7/00*** | (2006.01) |
| ***B41J 11/00*** | (2006.01) |
| ***B41M 5/025*** | (2006.01) |
| ***B41M 5/00*** | (2006.01) |
| *B41J 2/01* | (2006.01) |

(52) U.S. Cl.

CPC ..... *B41J 2/0057* (2013.01); *B41J 11/007* (2013.01); *B41J 29/17* (2013.01); *B41M 5/0017* (2013.01); *B41M 5/0256* (2013.01); *B41M 7/0018* (2013.01); *B41J 2002/012* (2013.01)

(58) Field of Classification Search

CPC ..... B41J 2/0057; B41J 29/17; B41J 11/007
USPC ..... 347/21, 103
See application file for complete search history.

(56) References Cited

U.S. PATENT DOCUMENTS

| | | | |
|---|---|---|---|
| 6,935,732 | B2 | 8/2005 | Takada et al. |
| 7,276,112 | B2 | 10/2007 | Tokuda et al. |
| 7,377,631 | B2 | 5/2008 | Takada et al. |
| 8,016,406 | B2 | 9/2011 | Hakamada et al. |
| 8,362,108 | B2 | 1/2013 | Imai |

(Continued)

FOREIGN PATENT DOCUMENTS

| | | | |
|---|---|---|---|
| JP | 2009-072928 | A | 4/2009 |
| JP | 2011-093198 | A | 5/2011 |
| JP | 2016-215642 | A | 12/2016 |

*Primary Examiner* — An H Do
(74) *Attorney, Agent, or Firm* — Venable LLP

(57) ABSTRACT

The method includes in order: forming an intermediate image by applying the aqueous ink to a transfer body; transferring the intermediate image by bringing the intermediate image into contact with the recording medium; and cleaning the transfer body by applying an aqueous cleaning liquid to the transfer body, and if necessary, further includes applying an aqueous reaction liquid containing a reactant which reacts with the aqueous ink to the transfer body, wherein at least one of the aqueous ink and the reaction liquid contains a resin particle (however, when not including the applying of the reaction liquid, the aqueous ink contains the resin particle), and the cleaning liquid contains a first water-soluble organic solvent having an SP value [unit: $(J/cm^3)^{1/2}$] of 17.0 or more to 29.0 or less.

12 Claims, 1 Drawing Sheet

(56) References Cited

U.S. PATENT DOCUMENTS

| | | | |
|---|---|---|---|
| 9,566,781 | B2 | 2/2017 | Takeuchi et al. |
| 9,624,395 | B2 | 4/2017 | Kaji et al. |
| 9,783,694 | B2 | 10/2017 | Tominaga et al. |
| 9,969,182 | B2 | 5/2018 | Torisaka et al. |
| 9,981,480 | B2 | 5/2018 | Imai et al. |
| 10,017,656 | B2 | 7/2018 | Torisaka et al. |
| 2011/0050795 | A1* | 3/2011 | Arai ..... C09B 67/0013 347/28 |
| 2011/0074871 | A1* | 3/2011 | Uchiyama ..... B41J 2/1606 347/28 |
| 2016/0075898 | A1 | 3/2016 | Imai et al. |
| 2016/0075899 | A1 | 3/2016 | Imai et al. |
| 2016/0200925 | A1 | 7/2016 | Kaji et al. |
| 2017/0282533 | A1 | 10/2017 | Sakurada et al. |
| 2018/0093469 | A1 | 4/2018 | Sakurada et al. |

* cited by examiner

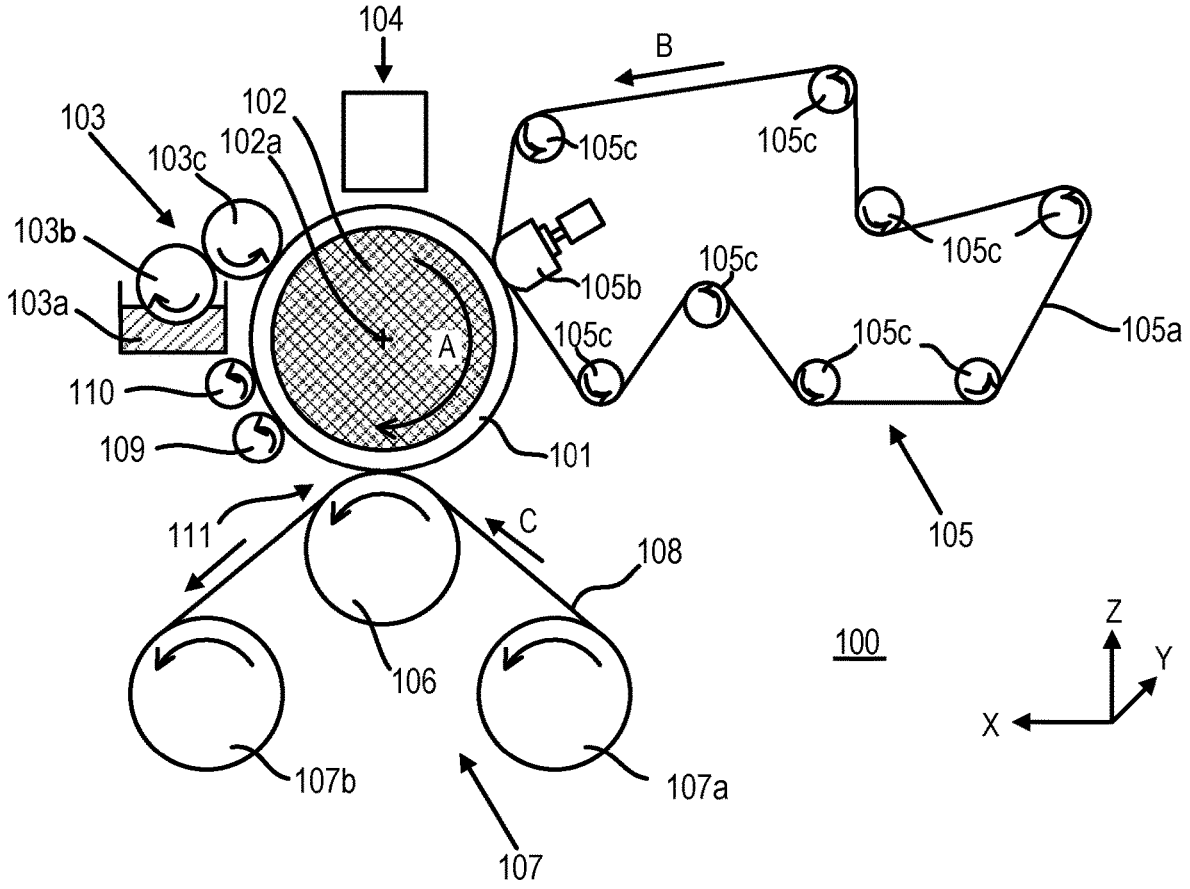
104
B
102
103
102a
103c
105c
105c
103b
105c
105c
105b
103a
105c
105c
105a
A
110
109
101
105
111
C
108
100
Z
Y
X
106
107b
107a
107

INK JET RECORDING METHOD AND INK JET RECORDING APPARATUS

BACKGROUND OF THE INVENTION

Field of the Invention

The present invention relates to an ink jet recording method and an ink jet recording apparatus.

Description of the Related Art

Aqueous ink has been widely used as ink used in an ink jet recording method. To promptly remove a liquid component in the ink, a so-called transfer type image recording method is used in which a liquid component contained in an intermediate image is removed while forming the intermediate image on a transfer body, and then the intermediate image is transferred onto a recording medium to record an image.

The transfer type ink jet recording method has a problem in that residues on the transfer body are highly likely to affect an image quality to be subsequently recorded and the image quality may be degraded. More specifically, the residues on the transfer body affect a contact state between the transfer body and the recording medium at the time of recording the image, such that transfer defects occur. If the occurrence of the transfer defects is insignificant, the image looks whitish (white spots occurs), whereas if the occurrence of the transfer defects is severe, dot defects may occur, such that the image quality is degraded.

In order to solve the problems as described above, for example, a method for cleaning a transfer body by applying a cleaning liquid containing a component which aggregates a coloring component in ink has been proposed (Japanese Patent Application Laid-Open No. 2011-093198). Further, in the case of using a reaction liquid containing a nonionic surfactant, a recording method for specifying a relationship between a temperature and a clouding point of a reaction liquid and a temperature and a clouding point of a mixture of the reaction liquid and a cleaning liquid of a transfer body has been proposed (Japanese Patent Application Laid-Open No. 2016-215642). Further, an image forming apparatus including a unit which applies a liquid to a transfer body to clean the transfer body and a unit which brings an adhesive unit, which has an adhesion larger than that of the transfer body, into contact with the transfer body to clean the transfer body has been proposed (Japanese Patent Application Laid-Open No. 2009-072928).

The present inventors have studied repeatedly recording an image using the apparatuses and the like which are proposed in Japanese Patent Application Laid-Open No. 2011-093198, Japanese Patent Application Laid-Open No. 2016-215642 and Japanese Patent Application Laid-Open No. 2009-072928. As a result, it was found is that due to the repeated recording of the image, the cleaning of the transfer body becomes insufficient and the degradation in image quality such as the dot defects or the white spots is likely to occur.

SUMMARY OF THE INVENTION

An object of the present invention is to provide a transfer type ink jet recording method capable of making cleaning performance of a transfer body good and repeatedly recording a high-quality image with little dot defects or white spots. Another object of the present invention is to provide an ink jet recording apparatus used in the ink jet recording method.

That is, according to the present invention, provided is an ink jet recording method for recording an image on a recording medium using an aqueous ink, the method including in order: forming an intermediate image by applying the aqueous ink to a transfer body; transferring the intermediate image by bringing the intermediate image into contact with the recording medium; and cleaning the transfer body by applying an aqueous cleaning liquid to the transfer body, and if necessary, further including applying an aqueous reaction liquid containing a reactant which reacts with the aqueous ink to the transfer body, wherein at least one of the aqueous ink and the reaction liquid contains a resin particle (however, when not including the applying of the reaction liquid, the aqueous ink contains the resin particle), and the cleaning liquid contains a first water-soluble organic solvent having an SP value [unit: $(J/cm^3)^{1/2}$], which is obtained by a Fedors method, of 17.0 or more to 29.0 or less.

According to the present invention, it is possible to provide the transfer type ink jet recording method capable of making the cleaning performance of the transfer body good and repetitively recording the high-quality image with little dot defects or white spots. In addition, according to the present invention, it is possible to provide the ink jet recording apparatus used in the ink jet recording method.

Further features of the present invention will become apparent from the following description of exemplary embodiments with reference to the attached drawing.

BRIEF DESCRIPTION OF THE DRAWINGS

FIGURE is a schematic diagram showing an ink jet recording apparatus according to an embodiment of the present invention.

DESCRIPTION OF THE EMBODIMENTS

Preferred embodiments of the present invention will now be described in detail in accordance with the accompanying drawing.

Hereinafter, the present invention will be described in more detail with reference to preferred embodiments. In the present invention, when a compound is salt, although the salt in ink remains dissociated in ions, for convenience sake, the salt in ink is expressed by "containing salt". In addition, aqueous ink and a reaction liquid for an ink jet may be simply referred to as "ink" and "reaction liquid". Physical property values are values at room temperature (25° C.) unless otherwise specified. "(meth)acrylic acid" and "(meth) acrylate" each means "acrylic acid and methacrylic acid" and "acrylate and methacrylate".

As a cleaning liquid used in an ink jet recording method, a cleaning liquid (wiping liquid) used for cleaning a surface on which an ejection orifice of a recording head is formed is cleaned by wiping or the like has been known. The cleaning liquid for the recording head is a composition which focuses on dissolving dried ink again. On the other hand, compositions and the like of a cleaning liquid used for a transfer body need to be designed to be different from those of the cleaning liquid for the recording head because residues on the transfer body are not dry matters.

The present inventors have investigated reasons why the image quality is degraded by repeated recording. Components not transferred onto the recording medium remain as residues on the transfer body after an intermediate image is transferred onto the recording medium. Since the transfer body is used repeatedly, if the residues are insufficiently removed by the cleaning, an intermediate image is formed on the residues in subsequent steps. Since the intermediate image formed on the residues is hardly transferred onto the recording medium, it is considered that dot defects or white spots are likely to occur and the image quality is degraded. In particular, when a liquid containing a resin particle is used to form the intermediate image, the resin particle acts like an adhesive to be likely to remain on the transfer body. In particular, when an image is recorded at high speed, the cleaning is also done at a high speed, so that residues may be easily generated on the transfer body.

Under such circumstances, the present inventors have found the configuration of the present invention by considering that there is a need to weaken an adhesive force between the resin particle and the transfer body to suppress a degradation in image quality due to repeated recording using a liquid (ink or reaction liquid) containing the resin particle. Specifically, the present inventors have found that a water-soluble organic solvent is likely to penetrate into an interface between a resin component in the residues and the transfer body due to the use of an aqueous cleaning liquid containing the water-soluble organic solvent having an SP value of 17.0 or more to 29.0 or less. It is possible to easily remove the residues from the transfer body and suppress the degradation in the image quality by cleaning the transfer body using the cleaning liquid. The water-soluble organic solvent having the SP value of 17.0 or more to 29.0 or less is considered to generate the above-mentioned action since the water-soluble organic solvent is excellent in affinity with the resin particle which can be used from the viewpoint of storage stability of liquid, ink jet suitability or the like when using the aqueous ink or the aqueous reaction liquid. However, if the SP value of the water-soluble organic solvent is less than 17.0 or more than 29.0, it is difficult to remove the residues and the degradation in the image quality cannot be suppressed. In addition, if the liquid containing the resin particle is not used, the stickiness of the residue is not so high, such that the problem of the dot defects and the white spots caused by the residues is not obvious.

<Ink Jet Recording Method and Ink Jet Recording Apparatus>

The ink jet recording method of the present invention (hereinafter, also simply referred to as "recording method") is a method for recording an image on a recording medium using an aqueous ink. The recording method of the present invention includes an intermediate image forming step of forming an intermediate image by applying aqueous ink to a transfer body, a transferring step of transferring the intermediate image by bringing the intermediate image into contact with the recording medium and a cleaning step of cleaning the transfer body by applying an aqueous cleaning liquid to the transfer body in order. That is, the recording method of the present invention is a transfer type ink jet recording method. If necessary, the recording method may further include a reaction liquid applying step of applying to the transfer body an aqueous reaction liquid containing a reactant which reacts with the aqueous ink.

In addition, an ink jet recording apparatus of the present invention (hereinafter, also simply referred to as "recording apparatus") is an apparatus used for recording an image on a recording medium using an aqueous ink. The recording apparatus of the present invention includes: an ink applying unit which ejects aqueous ink by an ink jet system and applies the aqueous ink to a transfer body to form an intermediate image; a transfer unit which transfers the intermediate image by bringing the intermediate image into contact with a recording medium; and a cleaning unit which applies an aqueous cleaning liquid to the transfer body to clean the transfer body. In other words, the recording apparatus of the present invention is a so-called transfer type ink jet recording apparatus. If necessary, the recording apparatus of the present invention may further include a reaction liquid applying unit which applies to the transfer body an aqueous reaction liquid containing a reactant which reacts with the aqueous ink.

FIGURE is a schematic diagram showing an ink jet recording apparatus according to an embodiment of the present invention. A transfer type ink jet recording apparatus 100 shown in FIGURE is a sheet type ink jet recording apparatus which transfers an intermediate image onto a recording medium 108 via a transfer body 101 to produce recorded matters. An X direction, a Y direction and a Z direction respectively indicate a width direction (full length direction), a depth direction and a height direction of the transfer type ink jet recording apparatus 100. The recording medium is conveyed in the X direction.

A transfer type ink jet recording apparatus 100 includes a transfer body 101, a reaction liquid applying device 103, an ink applying device 104, a liquid absorbing device 105 and a pressing member 106. The transfer body 101 is supported on a support member 102. The reaction liquid applying device 103 is a device which applies a reaction liquid containing a reactant reacting with ink to the transfer body 101. The ink applying device 104 includes a recording head which applies ink to the transfer body 101 to which the reaction liquid is applied to form an intermediate image. The liquid absorbing device 105 is a device which absorbs a liquid component from the intermediate image. The pressing member 106 is a member which transfers the intermediate image, from which the liquid component is removed, onto the sheet-like recording medium 108 such as paper. The transfer type ink jet recording apparatus 100 further includes a cleaning member for transfer body 109 which cleans a surface of the post-transfer transfer body 101. The transfer body 101, the reaction liquid applying device 103, the recording head of the ink applying device 104, the liquid absorbing device 105 and the cleaning member for transfer body 109 each have a length corresponding to the recording medium 108 used in the Y direction.

The transfer body 101 rotates in a direction of an arrow A about a rotating shaft 102*a* of the support member 102. The reaction liquid is applied from the reaction liquid applying device 103 to the rotating transfer body 101 and then the ink is applied from the ink applying device 104, so the intermediate image is formed on the transfer body 101. The intermediate image formed on the transfer body 101 moves up to a position where the intermediate image comes into contact with a liquid absorbing member 105*a* of the liquid absorbing device 105 by the rotation of the transfer body 101.

The liquid absorbing member 105*a* configuring the liquid absorbing device 105 moves (rotates) in a direction of an arrow B in synchronization with the rotation of the transfer body 101. The intermediate image formed on the transfer body 101 comes into contact with the moving liquid absorbing member 105*a*. In the interim, the liquid absorbing member 105*a* absorbs and removes the liquid component from the intermediate image. From the viewpoint of efficiently absorbing the liquid component from the intermediate image, the liquid absorbing member 105*a* is preferably pressed against the transfer body 101 with a predetermined pressing force. The intermediate image is formed of the ink and the reaction liquid used as necessary. Therefore, absorbing the liquid component from the intermediate image refers to absorbing the liquid component in the ink and the reaction liquid used as necessary. It can be also said that the liquid component from the intermediate image refers to concentrating the ink or the like. By concentrating the ink or the like, a ratio of a solid content of a coloring material, a resin or the like with respect to the liquid component increases.

The intermediate image in which the liquid component is removed and the ink is concentrated is moved to a transfer part 111 which comes into contact with the recording medium 108, which is conveyed by a recording medium conveying device 107, by the rotation of the transfer body 101. The intermediate image and the recording medium 108 come into contact with each other by being pressed from the pressing member 106 in the state in which the intermediate image and the recording medium 108 are sandwiched between the transfer body 101 and the pressing member 106. In the case of using the roller-like transfer body 101 and the columnar pressing member 106, the intermediate image and the recording medium 108 come into linear contact each other along the Y direction. If the transfer body 101 formed of an elastic material is used, since the transfer body 101 is depressed by pressing, the intermediate image and the recording medium 108 come into contact with each other on a surface. For this reason, a line or a surface where the intermediate image and the recording medium 108 are in contact is defined as a "region", and a part including this region is defined as the transfer part 111. While the intermediate image comes into contact with the recording medium 108, the pressing member 106 presses the transfer body 101 to transfer the intermediate image onto the recording medium 108, so the desired image is recorded on the recording medium 108. The post-transfer image is a reverse image of the pre-transfer intermediate image.

If the reaction liquid is applied to the transfer body using a roller-like reaction liquid applying member 103*c*, the reaction liquid is applied over the whole transfer body. Since the intermediate image is formed by applying the ink to the transfer body to which the reaction liquid is applied, the reaction liquid which does not react with the ink remains in the region in which the ink is not applied in the transfer body. The liquid absorbing member 105*a* can remove the liquid components from the unreacted reaction liquid as well as the intermediate image. The liquid component contained in the ink or the reaction liquid is present in a substantially constant volume while having flowability but not having a fixed form. The liquid component contained in the ink or the reaction liquid is specifically an aqueous medium or the like.

Hereinafter, [1] the transfer body, [2] the support member, [3] the reaction liquid applying device, [4] the ink applying device, [5] the liquid absorbing device, [6] the pressing member, [7] the recording medium, [8] the recording medium conveying device and [9] the cleaning device which are the main components of the transfer type ink jet recording apparatus will be described.

[1] Transfer Body

The transfer body 101 has a surface layer including a surface on which the intermediate image is formed. Examples of the material constituting the surface layer may include a resin, a ceramic and the like. Among those, a resin material having a siloxane structure is preferable, and from the viewpoint of durability, a material having high compressive elastic modulus is preferable. Surface treatment may be performed to improve wettability, transferability or the like of the reaction liquid.

It is preferable that the transfer body has a compressive layer which is disposed between the surface layer and the support member and serves to absorb pressure fluctuations. The compressive layer disperses local pressure fluctuations and absorbs a deformation of the surface layer. Therefore, it is possible to maintain good transferability even in the case of high-speed recording by providing the compressive layer. Examples of a material constituting the compressive layer may include an elastic material such as a rubber material. Among those, a rubber material having a porous structure which is formed by blending fillers, such as a foaming agent, hollow fine particles and salt with raw rubber along with a vulcanizing agent and a vulcanization accelerator is preferable. Since the elastic material is compressed with a change in volume of a void part upon the pressure fluctuation, a deformation in directions other than the compression direction is small. Therefore, it is possible to improve the transferability and the durability. Examples of the porous structure may include a continuous void structure in which voids are connected to each other or an independent void structure in which voids are separated from each other.

It is preferable that the transfer body further has an elastic layer between the surface layer and the compressive layer. Examples of configuration of the elastic layer may include a resin material, a ceramic material and the like. Among those, it is preferable to use the elastic materials such as the rubber material because the elastic materials are easily processed and have the small change in elastic modulus with temperature and the excellent transferability.

Each layer (surface layer, elastic layer and compressive layer) configuring the transfer body can be bonded to each other by an adhesive or a double-sided tape. A reinforcing layer having a high compressive elastic modulus may be provided to suppress a transverse elongation at the time of installation in the apparatus to preserve stiffness. As the reinforcing layer, a woven fabric or the like can be used. Among the layers configuring the transfer body, the elastic layer or the compressive layer other than the surface layer can be arbitrarily combined. A size of the transfer body can be freely selected according to a recording speed and a size of an image. A form of the transfer body can be, for example, a sheet form, a roller form, a belt form or an endless web form.

[2] Support Member

The transfer body 101 is supported on the support member 102. The transfer body can be disposed on a support by using, for example, an adhesive or a double-sided tape. The transfer body 101 may be disposed on the support member 102 using an installation member formed of metal, a ceramic, a resin and the like. The support member 102 needs to have a certain degree of structural strength from the viewpoint of conveyance accuracy and durability. Examples of the material of the support member may include metal, ceramic, resin and the like. Among those, it is preferable to use metallic materials such as aluminum. It is possible to reduce inertia during the operation and improve control responsiveness in addition to rigidity withstanding a stress during transferring and dimensional accuracy by using the metallic materials.

[3] Reaction Liquid Applying Device

The recording method of the present invention preferably includes the reaction liquid applying step which applies the reaction liquid to the transfer body before the intermediate image forming step. The reaction liquid reacts with the ink by contacting the ink, and contains a reactant which aggregates components having anionic groups such as a resin and a self-dispersible pigment in ink. After applying the ink, the reaction liquid may be further applied to overlap with at least a part of a region to which the ink is applied.

The transfer type ink jet recording apparatus 100 shown in FIGURE includes a reaction liquid applying device 103 as a reaction liquid applying unit which applies the reaction liquid to the transfer body 101. The reaction liquid applying device 103 is a gravure offset roller which includes a reaction liquid container 103*a* which contains the reaction liquid and reaction liquid applying members 103*b* and 103*c* which apply the reaction liquid in the reaction liquid container 103*a* to the transfer body 101. Examples of the reaction liquid applying device include the gravure offset roller, an ink jet type recording head and the like. Among those, it is preferable to use a roller to apply the reaction liquid to the transfer body. However, when the roller is used to apply the reaction liquid to the transfer body, the reaction liquid is uniformly applied to a region corresponding to the recording medium, regardless of application of the ink, unless special devises are made. In this case, if an unreacted reaction liquid is present in the region to which the ink is not applied and residues in this region are insufficiently removed, the region in which the residues are present has different reactivity from the region in which residues are not present, such that the image quality is particularly likely to be degraded. Even in the case, if a cleaning liquid containing a first water-soluble organic solvent is used, it is possible to effectively remove the residues.

[4] Ink Applying Device

The transfer type ink jet recording apparatus 100 shown in drawing has the ink applying device 104 as a unit which applies the ink to the transfer body 101. It is preferable that an ink jet type recording head is used as the ink applying device to eject and apply the ink. Examples of the type of the recording head may include a type in which film boiling is caused in the ink by an electrothermal transducer to form bubbles in order to eject the ink, a type in which the ink is ejected by the electromechanical transducer, a type in which the ink is ejected by static electricity and the like. Among those, the recording head using the electrothermal transducer is preferable because it can record an image at a higher speed and a higher density.

The recording head is a full line head extending in the Y direction, and ejection orifices are arranged in a range covering the width of the image recording region of the recording medium of the available maximum size. The recording head has an ejection orifice surface on which the ejection orifices are open, with the ejection orifice surface disposed on a lower surface (transfer body 101 side) of the recording head. The ejection orifice surface faces the surface of the transfer body 101 with a minute gap (about several millimeters).

The ink applying device 104 may have a plurality of recording heads to apply inks of respective colors such as cyan, magenta, yellow and black (CMYK) to the transfer body 101. For example, when the intermediate image is formed using four kinds of inks of the CMYK, the ink applying device has four ink heads which ejects four kinds of inks of the CMYK. These ink heads are arranged in the X direction.

[5] Liquid Absorbing Device

The liquid absorbing device 105 has a liquid absorbing member 105*a* and a pressing member 105*b* for liquid absorption which presses the liquid absorbing member 105*a* against the intermediate image of the transfer body 101. When the liquid absorbing device 105 is configured by the columnar pressing member 105*b* and the belt-like liquid absorbing member 105*a*, the pressing member 105*b* presses the liquid absorbing member 105*a* against the transfer body 101, thereby absorbing the liquid component from the intermediate image. Further, it is possible to absorb the liquid component from the intermediate image even by pressing a columnar pressing member having a liquid absorbing member attached to an outer circumferential surface thereof against the transfer body. Taking into consideration a space and the like in the recording apparatus, it is preferable that the form of the liquid absorbing member 105*a* is the belt form. The liquid absorbing device 105 having the belt-like liquid absorbing member 105*a* may have an extending member such as an extending roller 105*c* which extends the liquid absorbing member 105*a*.

It is possible to cause the liquid absorbing member 105*a* to absorb the liquid component contained in the intermediate image by bringing the liquid absorbing member 105*a* including the porous layer into contact with the intermediate image by using the pressing member 105*b*. As the method for absorbing a liquid component contained in an intermediate image, the method for bringing a liquid absorbing member into contact with an intermediate image may not only be used, but a method of heating, a method of blowing low-humidity air, a method of reducing pressure and the like may also be used in combination. In addition, these methods may be applied to the intermediate image before and after the liquid component are absorbed.

The liquid absorbing member 105*a* rotates in conjunction with the rotation of the transfer body 101. Therefore, the form of the liquid absorbing member 105*a* is preferably a form capable of repeatedly absorbing a liquid, specifically, an endless belt form, a drum form or the like. The liquid component absorbed into the liquid absorbing member 105*a* including the porous layer can be removed from the liquid absorbing member 105*a* by a method for absorbing a liquid component from a back surface of a porous layer, a method for using a member handling a porous member or the like. After the liquid component is removed, the liquid absorbing member 105*a* is rotated to come into contact with a new intermediate image, thereby efficiently absorbing the liquid component contained in the intermediate image.

[6] Pressing Member

The recording apparatus of the present invention includes the transfer unit which brings the intermediate image into contact with the recording medium to transfer the intermediate image. Specifically, as shown in FIGURE, the intermediate image after the removal of the liquid on the transfer body 101 is transferred onto the recording medium 108 conveyed by the recording medium conveying device 107 by contacting the transfer part 111 by the pressing member 106. It is possible to suppress curling, cockling and the like of the recording medium 108 by transferring the intermediate image onto the recording medium 108 after the removal of the liquid component.

The pressing member 106 preferably has the appropriate structural strength from the viewpoint of the conveyance accuracy and durability of the recording medium 108. Examples of the material of the pressing member 106 may include metal, ceramic, resins and the like. Among those, metals such as aluminum are preferable from the viewpoint of improving the control responsiveness by reducing the inertia during the operation as well as having the rigidity withstanding the stress at the time of the transfer or the dimensional accuracy.

It is preferable that the time (pressing time) taken for the pressing member 106 to press the transfer body 101 at the time of transferring the intermediate image onto the recording medium 108 is 5 milliseconds or more to 100 milliseconds or less. It is possible to suppress the damage to the transfer body 101 as well as making the transfer good by setting the pressing time as described above. The pressing time is the time during which the recording medium 108 and the transfer body 101 come into contact with each other. The pressing time can be calculated by measuring a surface pressure using a pressure distribution system and dividing a conveying direction length of a pressing region by a conveying speed. Specifically, the surface pressure distribution measuring device (trade name "I-SCAN", manufactured by Nitta Corporation) or the like can be used.

It is preferable that the pressure (pressing force) at which the pressing member 106 presses the transfer body 101 is 9.8 N $cm^2$ (1 $kg/cm^2$) or more to 294.2 $N/cm^2$ (30 $kg/cm^2$) or less at the time of transferring the intermediate image onto the recording medium 108. It is possible to suppress the damage to the transfer body 101 as well as making the transfer good by setting the pressing force as described above. The pressing force is a nip pressure of the recording medium 108 and the transfer body 101. The pressing force can be calculated by measuring the surface pressure using the pressure distribution measuring system and dividing weighting in the pressed region by an area. Specifically, the surface pressure distribution measuring device (trade name "I-SCAN", manufactured by Nitta Corporation) or the like can be used.

The temperature when the pressing member 106 presses the transfer body 101 is preferably a temperature equal to or higher than a glass transition point (or softening point) of the resin component contained in the intermediate image. To control the temperature depending on the properties the resin component, the recording apparatus preferably includes a heating unit which heats the intermediate image on the transfer body 101, the transfer body 101 and the recording medium 108. Examples of the form of the pressing member 106 may include forms such as the roller form.

[7] Recording Medium

As the recording medium 108, any known recording medium can be used. Examples of the recording medium may include a long object wound in a roll form, a sheet type cut into a predetermined size and the like. Examples of the constituent materials of the recording medium may include paper such as coated paper and plain paper, films such as plastic and metal, wood board, cardboard and the like.

[8] Recording Medium Conveying Device

The recording medium conveying device 107 which conveys the recording medium 108 conveys the recording medium 108 in a direction of an arrow C. The recording medium conveying device 107 is configured by a recording medium feeding roller 107*a* and a recording medium winding roller 107*b*. The conveying speed of the recording medium 108 is preferably determined in consideration of a speed required in each step.

[9] Cleaning Device

As shown in FIGURE, the recording apparatus of the present invention has a cleaning device which is a cleaning unit for applying an aqueous cleaning liquid to the transfer body 101 to clean the transfer body 101. The cleaning device includes a cleaning member for transfer body 109 which applies a cleaning liquid to the transfer body 101 to clean the transfer body 101. It is possible to suppress the degradation in the image quality by cleaning the transfer body 101 using the cleaning member for transfer body 109. As the cleaning member for transfer body 109, a cleaning member having forms such as a roller and a web can be used. The cleaning device can be provided with a cleaning liquid supplying unit which supplies the cleaning liquid to the cleaning member for transfer body 109.

Further, it is preferable that the cleaning device includes a cleaning liquid removing member 110 which removes the cleaning liquid remaining on the cleaned transfer body 101. It is possible to effectively suppress the degradation in the image quality by removing the cleaning liquid or the like, which remains on the transfer body 101, by the cleaning liquid removing member 110. Examples of the method for removing the cleaning liquid remaining on the transfer body 101 can include blade removal, brush removal, liquid absorption by an absorber and the like. Among those, it is preferable to remove the cleaning liquid remaining on the transfer body 101 by the liquid absorption by the absorber. As the cleaning liquid removing member 110, a porous body or the like used as the liquid absorbing member can be used.

(Reaction Liquid)

The recording method of the present invention preferably has a reaction liquid applying step of applying the aqueous reaction liquid containing the reactant, which reacts with the aqueous ink, to the transfer body. Hereinafter, each component used in the reaction liquid will be described in detail.

[Reactant]

The reaction liquid reacts with the ink by contacting the ink, aggregates the components (components having the anionic groups such as the resin and the self-dispersible pigment) in the ink, and contains the reactant. Examples of the reactant may include polyvalent metal ion, cationic components such as a cationic resin, an organic acid or the like. Among those, the reactant is preferably the organic acid, more preferably a polyvalent carboxylic acid (which may be a salt or a hydrogen salt) of bivalence or more.

Examples of the polyvalent metal ions may include divalent metal ions such as $Ca^{2+}$, $Cu^{2+}$, $Ni^{2+}$, $Mg^{2+}$, $Sr^{2+}$, $Ba^{2+}$ and $Zn^{2+}$ and trivalent metal ions such as $Fe^{3+}$, $Cr^{3+}$, $Y^{3+}$ and $Al^{3+}$. To contain the polyvalent metal ions in the reaction liquid, a polyvalent metal salt (which may be a hydrate) formed by combining the polyvalent metal ions with anion can be used. Examples of the anion may include: inorganic anions such as $Cl^-$, $Br^-$, $I^-$, $ClO^-$, $ClO_2^-$, $ClO_3^-$, $ClO_4^-$, $NO_2^-$, $NO_3^-$, $SO_4^{2-}$, $CO_3^{2-}$, $HCO_3^-$, $PO_4^{3-}$, $HPO_4^{2-}$ and $H_2PO_4^-$; and organic anions such as $HCOO^-$, $(COO^-)_2$, $COOH(COO^-)$, $CH_3COO^-$, $C_2H_4(COO^-)_2$, $C_6H_5COO^-$, $C_6H_4(COO^-)_2$ and $CH_3SO_3^-$. When the polyvalent metal ions are used as the reactant, a content (% by mass) in terms of the polyvalent metal salt in the reaction liquid is preferably 1.0% by mass or more to 20.0% by mass or less with respect to the total mass of the reaction liquid.

The reaction liquid containing the organic acid has buffering ability in an acidic region (pH of less than 7.0, preferably pH of 2.0 to 5.0) to efficiently make the anionic group of the components present in the ink into an acid form, thereby aggregating the components. Examples of the organic acid may include monocarboxylic acid such as formic acid, acetic acid, propionic acid, butyric acid, benzoic acid, glycolic acid, lactic acid, salicylic acid, pyrrolecarboxylic acid, furancarboxylic acid, picolinic acid, nicotinic acid, thiophene carboxylic acid, levulinic acid and coumaric acid and salts thereof; dicarboxylic acid such as oxalic acid, malonic acid, succinic acid, glutaric acid, adipic acid, maleic acid, fumaric acid, itaconic acid, sebacic acid, phthalic acid, malic acid and tartaric acid and salts or hydrogen salts thereof; tricarboxylic acids such as citric acid and trimellitic acid and salts or hydrogen salts thereof; tetracarboxylic acid such as pyromellitic acid and salts or hydrogen salts thereof and the like. It is preferable that the content (% by mass) of the organic acid in the reaction liquid is 1.0% by mass or more to 50.0% by mass or less with respect to the total mass of the reaction liquid.

Examples of the cationic resins may include a resin having a structure of primary to tertiary amines, a resin having a structure of a quaternary ammonium salt and the like. Specific examples thereof may include resins having structures of vinylamine, allylamine, vinylimidazole, vinylpyridine, dimethylaminoethyl methacrylate, ethyleneimine, guanidine and the like. To increase the solubility in the reaction liquid, the cationic resin and the acidic compound can be used in combination, or the quaternization treatment can also be performed on the cationic resin. When the cationic resin is used as the reactant, it is preferable that the content (% by mass) of the cationic resin in the reaction liquid is 1.0% by mass or more to 10.0% by mass or less with respect to the total mass of the reaction liquid.

[Resin Particle]

At least one of the aqueous ink and the reaction liquid used in the recording method of the present invention contains a resin particle. However, when the reaction liquid applying step is not provided (when the reaction liquid is not used), the aqueous ink contains the resin particle. It is possible to suppress a transfer failure and record a high-quality image by using the ink or the reaction liquid containing the resin particle. Examples of the resin particle contained in the reaction liquid may include an acrylic resin, a urethane resin, olefin-based resins such as polyethylene and polypropylene, paraffin wax, carnauba wax and the like. Among those, the acrylic resin, which is composed of units derived from (meth)acrylic acid or (meth)acrylate, is preferable. The content (% by mass) of the resin particle in the reaction liquid is preferably 3.0% by mass or more to 30.0% by mass or less more preferably 5.0% by mass or more to 20.0% by mass or less with respect to the total mass of the reaction liquid. It should be noted that the resin particle does not necessarily contain the coloring material.

[Other Components]

If necessary, the reaction liquid may contain various other components. Examples of other components may include the same as those of an aqueous medium and other additives to be described later which can be contained in the ink.

(Ink)

The ink used in the recording method of the present invention is preferably the aqueous ink for an ink jet which contains the coloring material. Hereinafter, each component or the like used in the ink will be described in detail.

[Coloring Material]

A pigment or a dye can be used as the coloring material to be contained in the ink. The content (% by mass) of the coloring material in the ink is preferably 0.5% by mass or more to 15.0% by mass or less and more preferably 1.0% by mass or more to 10.0% by mass or less with respect to the total mass of the ink.

Specific examples of the pigment may include inorganic pigments such as carbon black and titanium oxide and organic pigments such as azo, phthalocyanine, quinacridone, isoindolinone, imidazolone, diketopyrrolopyrrole and dioxazine.

As the dispersion type of the pigment, a resin-dispersed pigment using a resin as a dispersant, a self-dispersible pigment in which a hydrophilic group is bonded to a surface of a pigment particle and the like can be used. In addition, a resin-bonded pigment in which an organic group containing a resin is chemically bonded to the surface of the pigment particle, a microcapsule pigment in which the surface of the pigment particle is coated with a resin or the like can be used. In the present invention, it is preferable to use a resin-dispersed pigment in which a resin as a dispersant is physically adsorbed to the surface of the pigment particle, rather than the resin-bonded pigment or the microcapsule pigment.

As the resin dispersant for dispersing the pigment in the aqueous medium, it is preferable to use a resin dispersant which can disperse the pigment in the aqueous medium by the action of the anionic group. As the resin dispersant, a resin to be described later, in particular, a water-soluble resin can be used. The content (% by mass) of the pigment in the ink is preferably 0.3 times or more to 10.0 times or less the mass ratio with respect to the content of the resin dispersant.

As the self-dispersible pigment, a pigment in which anionic groups such as a carboxylic acid group, a sulfonic acid group and a phosphonic acid group are directly bonded to the surface of the pigment particle or bonded thereto via another atomic group (—R—) can be used. The anionic group may be either an acid form or a salt form. In the case of the salt form, the anionic group may be either in a state in which the salt is partially dissociated or in a state in which the salt is completely dissociated. When the anionic group is the salt form, examples of the cation which becomes counter ion may include alkali metal cation, ammonium, organic ammonium and the like. Specific examples of another atomic group (—R—) may include a linear or branched alkylene group having 1 to 12 carbon atoms, arylene groups such as a phenylene group and a naphthylene group, a carbonyl group, an imino group, an amide group, a sulfonyl group, an ester group, an ether group and the like. In addition, it may also be a group formed by combining these groups.

A dye having an anionic group is preferably used as a dye. Specific examples of the dye may include dyes such as azo, triphenylmethane, (aza) phthalocyanine, xanthene and anthrapyridone. The coloring material contained in the ink used in the recording method of the present invention is preferably a pigment, more preferably a resin-dispersed pigment.

[Resin]

The ink may contain a resin. The content (% by mass) of the resin in the ink is preferably 0.1% by mass or more to 20.0% by mass or less and more preferably 0.5% by mass or more to 15.0% by mass or less with respect to the total mass of the ink.

The resin can be added to the ink as the resin dispersant or an aid thereof (i) to stabilize the dispersion state of the pigment. In addition, the resin can be added to the ink (ii) to improve various properties of the image to be recorded. As the form of the resin, there may be a block copolymer, a random copolymer, a graft copolymer, a combination thereof and the like. In addition, the resin may be a water-soluble resin which can be dissolved in the aqueous medium, and may also be the resin particle which is disposed in the aqueous medium. The resin particle does not necessarily contain the coloring material.

In the present specification, the "resin is water-soluble" means that when a resin is neutralized with alkali equivalent to the acid value, the resin is present in the aqueous medium in the state in which a particle whose diameter can be measured by a dynamic light scattering method are not formed. It may be determined whether the resin is water-soluble depending on the following method. First, a liquid (resin solid content: 10% by mass), which contains the resin neutralized with the alkali (sodium hydroxide, potassium hydroxide or the like) equivalent to the acid value, is prepared. Next, the prepared liquid is diluted with pure water by 10 times (volume basis) to prepare a sample solution. When the particle diameter of the resin in the sample solution is measured by the dynamic light scattering method, it can be determined that the resin is water-soluble in a case where the particle having a particle diameter is not measured. In this case, the measurement conditions can be as follows, for example.

[Measurement Condition]

SetZero: 30 seconds

Measurement number: Three times

Measurement time: 180 seconds

As a particle size distribution measuring device, a particle size analyzer (for example, trade name "UPA-EX 150" manufactured by Nikkiso Co., Ltd.) or the like by the dynamic light scattering method can be used. It goes without saying that the particle size distribution measuring apparatus to be used, the measurement conditions and the like are not limited thereto.

The acid value of the water-soluble resin is preferably 100 mgKOH/g or more to 250 mgKOH/g or less. The acid value of the resin constituting the resin particle is preferably 5 mgKOH/g or more to 100 mgKOH/g or less. A weight average molecular weight of the water-soluble resin is preferably 3,000 or more to 15,000 or less. A weight average molecular weight of the resin constituting the resin particle is preferably 1,000 or more to 2,000,000 or less. A volume average particle diameter of the resin particle measured by the dynamic light scattering method is preferably 50 nm or more to 500 nm or less.

Examples of the resin may include an acrylic resin, a urethane-based resin, an olefin-based resin and the like. Among those, the acrylic resin or the urethane-based resin is preferable, and an acrylic resin composed of units derived from (meth) acrylic acid or (meth) acrylate is more preferable.

As the acrylic resin, a resin which has a hydrophilic unit and a hydrophobic unit as a constitutional unit is preferably used. Among those, a resin having a hydrophilic unit derived from (meth) acrylic acid and a hydrophobic unit derived from at least one of a monomer having an aromatic ring and a (meth) acrylic acid ester based monomer is preferable. In particular, a resin having a hydrophilic unit derived from (meth) acrylic acid and a hydrophobic unit derived from at least one monomer of styrene and α-methylstyrene is preferable. Since these resins easily interact with the pigment, they can be suitably used as a resin dispersant for dispersing the pigment.

The hydrophilic unit is a unit having a hydrophilic group such as an anionic group. The hydrophilic unit can be formed by polymerizing, for example, a hydrophilic monomer having a hydrophilic group. Specific examples of the hydrophilic monomer having the hydrophilic group may include acidic monomers having carboxylic acid groups such as (meth) acrylic acid, itaconic acid, maleic acid and fumaric acid, anionic monomers such as anhydrides and salts of these acidic monomers and the like. Examples of the cation constituting the salt of the acidic monomer may include ions such as lithium, sodium, potassium, ammonium and organic. The hydrophilic unit is a unit which does not have a hydrophilic group such as an anionic group. The hydrophilic unit can be formed by polymerizing, for example, a hydrophilic monomer not having a hydrophilic group such as an anionic group. Specific examples of the hydrophobic monomer may include monomers having aromatic rings such as styrene, α-methylstyrene and benzyl (meth) acrylate, (meth) acrylate ester monomer such as methyl (meth) acrylate, butyl (meth) acrylate and 2-ethylhexyl (meth) acrylate and the like.

The urethane-based resin can be obtained, for example, by reacting polyisocyanate with polyol. In addition, the urethane-based resin can be obtained by the additional reaction of a chain extender. Examples of the olefin-based resin may include polyethylene, polypropylene and the like.

[Resin Particle]

At least one of the aqueous ink and the reaction liquid used in the recording method of the present invention contains a resin particle. However, when the reaction liquid applying step is not provided (when the reaction liquid is not used), the aqueous ink contains the resin particle. It is possible to suppress a transfer failure and record a high-quality image by using the ink or the reaction liquid containing the resin particle. It is preferable that both the aqueous ink and the reaction liquid contain the resin particle. As the resin particle to be contained in the ink, there may be the above-mentioned acrylic resin, urethane resin and the like. Among those, the acrylic-based resin, which is composed of units derived from (meth)acrylic acid or (meth) acrylate, is preferable. The content (% by mass) of the resin particle in the ink is preferably 1.0% by mass or more to 15.0% by mass or less and more preferably 5.0% by mass or more to 15.0% by mass or less with respect to the total mass of the ink. It should be noted that the resin particle does not necessarily contain the coloring material.

[Aqueous Medium]

The ink used in the recording method of the present invention is aqueous ink containing at least water as the aqueous medium. The ink can contain water or an aqueous medium which is a mixed solvent of water and a water-soluble organic solvent. It is preferable to use deionized water or ion-exchanged water as the water. The content (% by mass) of the water in the aqueous ink is preferably 50.0% by mass or more to 95.0% by mass or less with respect to the total mass of the ink. In addition, the content (% by mass) of the water-soluble organic solvent in the aqueous ink is preferably 3.0% by mass or more to 50.0% by mass or less with respect to the total mass of the ink. As the water-soluble organic solvent, any of alcohols, (poly) alkylene glycols, glycol ethers, nitrogen-containing compounds, sulfur-containing compounds and the like which can be used for the ink for the ink jet can be used.

[Other Additives]

In addition to the above components, if necessary, the ink may contain various additives such as an antifoaming agent, a surfactant, a pH adjusting agent, a viscosity adjusting agent, a rust-preventive agent, an antiseptic agent, a mildewproofing agent, an antioxidant and a reduction inhibitor. However, it is preferable that the ink does not contain the reactant used in the reaction liquid as described above. If the reactant is contained in the reaction liquid, the content of the reactant preferably is a negligible amount (the content of about 0.05% by mass or less).

(Cleaning Liquid)

The cleaning liquid used in the recording method of the present invention is an aqueous cleaning liquid containing a first water-soluble organic solvent having an SP value [unit: $(J/cm^3)^{1/2}$], which is obtained by a Fedors method, of 17.0 or more to 29.0 or less. Hereinafter, each component used in the cleaning liquid is described in detail.

[First Water-Soluble Organic Solvent]

The SP value [unit: $(J/cm^3)^{1/2}$] of the first water-soluble organic solvent is 17.0 or more to 29.0 or less. The SP value (δ) is a value obtained by a Fedors method. The SP value is also called "solubility parameter", and the smaller the difference between the SP value of the solute and the SP value of the solvent is, the greater the affinity of the solute to the solvent becomes. For this reason, the SP value can be used as an index for establishing the magnitude of the interaction between the two substances. In the present invention, the first water-soluble organic solvent having an SP value within a specific range is used taking into consideration the affinity with the resin particle having a general purpose composition to be contained in the ink or the reaction liquid.

Specifically, the SP value (δ) of the water-soluble organic solvent can be calculated by the following formula (1). In the following formula (1), $\Delta E_{vap}$ represents molar evaporation heat (J/mol) of the water-soluble organic solvent and V represents a molar volume ($cm^3$/mol) of the water-soluble organic solvent at 25° C. Both of the molar evaporation heat ($\Delta E_{vap}$) of the water-soluble organic solvent and the molar volume V of the water-soluble organic solvent at 25° C. can be obtained by adding constant values which are assigned to atoms and groups in a molecule. In the following description, the unit of the SP value may be omitted, but the SP value is a valued represented by a unit of $(J\ cm^3)^{1/2}$. It should be noted that it is general to use cal as the unit of the SP value, but when converting to the SI unit system, a relationship of $(cal/cm^3)^{1/2}=2.046\times10^3\ (J/m^3)^{1/2}$ may be used.

$$\delta = \sqrt{\frac{\Delta E_{vap}}{V}} \qquad \text{Formula (1)}$$

Specific examples of the first water-soluble organic solvent having an SP value of 17.0 or more to 29.0 or less may include 1,5-pentanediol (29.0), methanol (28.2), triethylene glycol (27.8), 1,6-hexanediol (27.7), 3-methyl-1,5-pentanediol (27.4), 2-methylpentane-2,4-diol (26.8), tetraethylene glycol (26.1), 1,2-butanediol (26.1), 2-pyrrolidone (25.9), ethanol (25.7), 1,2-pentanediol (25.0), ethylene glycol monomethyl ether (24.5), n-propanol (24.2), 1,2-hexanediol (24.1), 2-methyl-2-hydroxypentan-4-on (23.9), isopropanol (23.7), N-methyl-2-pyrrolidone (23.6), ethylene glycol monoethyl ether (23.5), 1,3-dimethyl-2-imidazolidinone (23.4), n-butanol (23.2), diethylene glycol monomethyl ether (23.0), 2-butanol (22.7), isobutanol (22.7), diethylene glycol monoethyl ether (22.4), tert-butanol (22.3), triethylene glycol monoethyl ether (21.7), polyethylene glycol (21.5) having a number average molecular weight of 600, diethylene glycol monobutyl ether (21.5), 3-methoxy-3-methylbutanol (21.5), triethylene glycol monobutyl ether (21.1), tetraethylene glycol monobutyl ether (20.8), polyethylene glycol (20.7) having a number average molecular weight of 1,000, acetone (18.6), tetraethylene glycol dimethyl ether (17.5), N-methylmorpholine (17.4), dimethyl sulfoxide (17.3), triethylene glycol butyl methyl ether (17.2) and the like (values in parentheses represent SP values). As the first water-soluble organic solvent, it is preferable to use those having a vapor pressure lower than that of water at a temperature of 25° C.

The first water-soluble organic solvent is preferably at least one selected from the group consisting of monohydric alcohol, dihydric alcohol and glycol ether. Among those, it is more preferable that the first water-soluble organic solvent is at least one of the monohydric alcohol and the dihydric alcohol. Among those, it is preferable to use those having a vapor pressure lower than that of water at a temperature of 25° C.

The alkyl group constituting the monohydric alcohol and the dihydric alcohol suitable as the first water-soluble organic solvent may be either a linear chain or a branched chain, and may also be substituted with an alkoxy group having 1 to 3 carbon atoms. Preferred examples of the monohydric alcohol may include methanol (28.2), ethanol (25.7), n-propanol (24.2), isopropanol (23.7), n-butanol (23.2), 2-butanol (22.7), isobutanol (22.7), tert-butanol (22.3), 3-methoxy-3-methylbutanol (21.5) and the like. Preferred examples of the dihydric alcohol may include 1,5-pentanediol (29.0), 1,6-hexanediol (27.7), 3-methyl-1,5-pentanediol (27.4), 2-methylpentane-2,4-diol (26.8), 1,2-butanediol (26.1), 1,2-pentanediol (25.0), 1,2-hexanediol (24.1) and the like.

Among those, 1,2-butanediol (26.1), 1,2-pentanediol (25.0) and 1,2-hexanediol (24.1) are particularly preferable as the first water-soluble organic solvent. It is possible to easily increase the wettability of the cleaning liquid and further improve the cleaning performance by using the first water-soluble organic solvent.

The content (% by mass) of the first water-soluble organic solvent is preferably 5.0% by mass or more to 50.0% by mass or less, more preferably 20.0% by mass or more to 40.0% by mass or less with respect to the total mass of the cleaning liquid. If the content of the first water-soluble organic solvent is excessively small, the permeation effect into the interface between the residues and the transfer body is somewhat weakened. On the other hand, if the content of the first water-soluble organic solvent is excessively large, the viscosity of the cleaning liquid increases, such that the cleaning performance may be somewhat low.

[Aqueous Medium]

The cleaning liquid used in the recording method of the present invention is the aqueous cleaning liquid containing at least water as the aqueous medium. The cleaning liquid can contain water or the aqueous medium which is the mixed solvent of the water and the water-soluble organic solvent. It is preferable to use deionized water or ion-exchanged water as the water. The content (% by mass) of the water in the cleaning liquid is preferably 50.0% by mass or more to 95.0% by mass or less with respect to the total mass of the cleaning liquid. Among those, the content of the water is preferably 60.0% by mass or more, and 80.0% by mass or less. If the content of the water is excessively small, the permeation effect into the interface between the residues and the transfer body may be weakened and the cleaning performance may be somewhat low.

The content (% by mass) of the water-soluble organic solvent in the cleaning liquid is preferably 5.0% by mass or more to 50.0% by mass or less, more preferably 20.0% by mass or more to 40.0% by mass or less with respect to the total mass of the cleaning liquid. The content is a value including the first aqueous organic solvent. Examples of the water-soluble organic solvent other than the first water-soluble organic solvent may include alcohols, (poly) alkylene glycols, glycol ethers, nitrogen-containing compounds, sulfur-containing compounds and the like. Specific examples of the water-soluble organic solvent other than the first water-soluble organic solvent may include glycerin (33.5), 1,3-propanediol (33.0), trimethylolpropane (32.6), 1,4-butanediol (30.7), diethylene glycol (30.6), ethylene glycol (30.3), 1,3-butanediol (30.3), 2-methyl-1,3-propanediol (30.3), 1,2,6-hexanetriol (29.7), urea (29.4), ethyleneurea (29.1), tetrahydrofuran (16.9), ethylene glycol dimethyl ether (15.6) and the like (values in parentheses represent SP values). As the water-soluble organic solvent other than the first water-soluble organic solvent, it is preferable to use those having a vapor pressure lower than that of water at a temperature of 25° C.

The viscosity of the cleaning liquid is preferably 15.0 mPa·s or less, more preferably 5.0 mPa·s or less, particularly preferably 1.5 mPa·s or less and further preferably 1.0 mPa·s or more. The cleaning liquid having the viscosity in the above range easily permeates into the interface between the residues and the transfer body, thereby more improving the cleaning performance. A surface tension of the cleaning liquid is preferably 65 mN/m or less and more preferably 40 mN/m or less. If the surface tension is excessively high, the permeation effect into the interface between the residues and the transfer body may be weakened, and the cleaning performance is somewhat low. The surface tension of the cleaning liquid is preferably 25 mN/m or more.

[Surfactant]

The cleaning liquid may contain a surfactant. Examples of the surfactant may include various surfactants such as anionic, cationic, amphoteric and nonionic surfactants. The content (% by mass) of the surfactant in the cleaning liquid is preferably 0.1% by mass or more to 5.0% by mass or less with respect to the total mass of the cleaning liquid.

[Other Components]

If necessary, the cleaning liquid may contain various other components. Other components may be the same those as the above-mentioned other additives and the like which can be contained in the ink. However, it is preferable that the cleaning liquid does not contain the reactant used for the reaction solution as described above. If the reactant is contained in the cleaning liquid, the content of the reactant preferably is a negligible amount (the content of about 0.05% by mass or less).

EXAMPLES

Hereinafter, the present invention will be described in more detail with reference to Examples and Comparative Examples, but the present invention is not limited to the following Examples as long as it does not deviate from the gist of the present invention. "unit" and "%" regarding a component amount are based on a mass unless otherwise specified.

<Preparation of Pigment Dispersion Liquid>

(Pigment Dispersion Liquid 1)

A styrene-ethyl acrylate-acrylic acid copolymer (resin 1) having an acid value of 150 mgKOH/g and a weight average molecular weight of 8,000 was prepared. With potassium hydroxide having a mole equivalent to an acid value thereof, 20.0 parts of the resin 1 was neutralized and added with an appropriate amount of pure water to prepare an aqueous solution of resin 1 in which a content of a resin (solid content) is 20.0%. By mixing 10.0 parts of pigment (C.I. Pigment Blue 15:3), 15.0 parts of the aqueous solution of the resin 1 and 75.0 parts of pure water, a mixture was obtained. The obtained mixture and 200 parts of zirconia beads having a diameter of 0.3 mm were charged into a batch type vertical sand mill (Manufactured by Aimex) and dispersed for 5 hours while being cooled with water. After the coarse particles were removed by centrifugal separation, the mixture was filtered under pressure by a cellulose acetate filter (manufactured by Advantech) having a pore size of 3.0 μm to prepare the pigment dispersion liquid 1 having the content of pigment of 10.0% and the content of resin dispersant (resin 1) of 3.0%.

(Pigment Dispersion Liquid 2)

The pigment dispersion liquid 2 having the content of pigment of 10.0% and the content of resin dispersant (resin 1) of 3.0% was prepared in the same manner as in the pigment dispersion liquid 1 except that the pigment is changed to C.I. Pigment Red 122.

(Pigment Dispersion Liquid 3)

The pigment dispersion liquid 3 having the content of pigment of 10.0% and the content of resin dispersant (resin 1) of 3.0% was prepared in the same manner as in the pigment dispersion liquid 1 except that the pigment is changed to C.I. Pigment Yellow 74.

(Pigment Dispersion Liquid 4)

The pigment dispersion liquid 4 having the content of pigment of 10.0% and the content of resin dispersant (resin 1) of 3.0% was prepared in the same manner as in the pigment dispersion liquid 1 except that the pigment is changed to carbon black.

<Preparation of Resin Particle>

(Resin Particle 1)

Into a four-necked flask equipped with a stirrer, a reflux condenser and a nitrogen gas inlet tube, 74.0 parts of ion exchange water and 0.2 parts of potassium persulfate were put and mixed. For preparing an emulsion, 24.0 parts of ethyl methacrylate, 1.5 parts of methacrylic acid and 0.3 parts of a reactive surfactant (trade name "Aqualon KH-05", manufactured by DKS Co., Ltd.) were mixed. Under the nitrogen atmosphere, the prepared emulsion was dropped into the above four-necked flask over 1 hour and polymerized for 2 hours while being stirred at 80° C. After being cooled to 25° C., the ion exchange water and the aqueous solution containing potassium hydroxide having a mole equivalent to the acid value of the resin particle were added to prepare an aqueous dispersion liquid of the resin particle 1 having the content of resin particle (solid content) of 25.0%.

(Resin Particle 2)

Into the four-necked flask equipped with the stirrer, the reflux condenser and the nitrogen gas inlet tube, 81.8 parts of ion exchange water and 0.2 parts of potassium persulfate were put and mixed. In addition, 16.1 parts of ethyl methacrylate, 1.6 parts of methoxy polyethylene glycol methacrylate and 0.3 parts of a reactive surfactant (trade name "Aqualon KH-05", manufactured by DKS Co., Ltd.) were mixed to prepare the emulsion. The trade name "Blemmer PME 1000" (manufactured by NOF CORPORATION, the number of added moles of ethylene oxide group is about 23) was used as the methoxypolyethylene glycol methacrylate. Under the nitrogen atmosphere, the prepared emulsion was dropped into the above four-necked flask over 1 hour and polymerized for 2 hours while being stirred at 80° C. After being cooled to 25° C., the ion exchange water and the aqueous solution containing potassium hydroxide having a mole equivalent to the acid value of the resin particle were added to prepare an aqueous dispersion liquid of the resin particle 2 having the content of resin particle (solid content) of 25.0%.

<Preparation of Ink>

Each component (unit: %) shown in Table 1 was mixed and sufficiently stirred, followed by pressure filtration with a cellulose acetate filter (manufactured by Advantec) having a pore size of 3.0 μm to prepare each ink. In Table 1, the "aqueous solution of the water-soluble resin 1" is the same as the "aqueous solution of the resin 1" used for preparing the pigment dispersion liquid. The numerical values attached to the polyethylene glycol are the number average molecular weight of the polyethylene glycol. "Acetylenol E100" is the trade name of a surfactant manufactured by Kawaken Fine Chemicals Co., Ltd.

TABLE 1

| Composition of ink | Ink | | | | | | |
|---|---|---|---|---|---|---|---|
| | 1 | 2 | 3 | 4 | 5 | 6 | 7 |
| Pigment dispersion liquid 1 | 3.0 | | | | | 3.0 | 3.0 |
| Pigment dispersion liquid 2 | | 3.0 | | | | | |
| Pigment dispersion liquid 3 | | | 3.0 | | | | |
| Pigment dispersion liquid 4 | | | | 3.0 | | | |
| Aqueous dispersion liquid of resin particle 1 | 8.0 | 8.0 | 8.0 | 8.0 | 10.0 | | |
| Aqueous dispersion liquid of resin particle 2 | | | | | | 8.0 | |
| Aqueous solution of resin 1 | 0.4 | 0.4 | 0.4 | 0.4 | 2.0 | 1.0 | 2.0 |
| Glycerin | 7.0 | 7.0 | 7.0 | 7.0 | 7.0 | 7.0 | 7.0 |
| Polyethylene glycol 1,000 | 3.0 | 3.0 | 3.0 | 3.0 | 3.0 | 3.0 | 3.0 |
| Acetylenol E100 | 0.5 | 0.5 | 0.5 | 0.5 | 0.5 | 0.5 | 0.5 |
| Ion exchange water | 78.1 | 78.1 | 78.1 | 78.1 | 77.5 | 77.5 | 84.5 |

<Preparation of Reaction liquid>

Each component (unit: %) shown in Table 2 was mixed and sufficiently stirred, followed by pressure filtration with a cellulose acetate filter (manufactured by Advantec) having a pore size of 3.0 μm to prepare each reaction liquid. In Table 2, "Megaface F444" is the trade name of a surfactant manufactured by DIC CORPORATION. "AQUACER 531" is the trade name of an aqueous dispersion liquid (content of resin (solid content): 35.0%) of a polyethylene-based wax manufactured by BYK Japan KK which was used as the resin particle.

TABLE 2

| Composition of reaction liquid | Reaction Liquid | | |
|---|---|---|---|
| | 1 | 2 | 3 |
| Malic acid | 30.0 | | 30.0 |
| Calcium nitrate | | 3.0 | |
| Glycerin | 7.0 | 7.0 | 7.0 |
| Megaface F444 | 5.0 | 5.0 | 5.0 |
| AQUACER 531 | | | 10.0 |
| Ion exchange water | 58.0 | 85.0 | 48.0 |

<Preparation of Cleaning Liquid>

Each component (unit: %) shown in Tables 3-1 to 3-3 was mixed and sufficiently stirred, followed by pressure filtration with the cellulose acetate filter (manufactured by Advantec) having a pore size of 3.0 μm to prepare each cleaning liquid. In Tables 3-1 to 3-3, the numerical values attached to the polyethylene glycol are the number average molecular weight of the polyethylene glycol. The numerical values in parentheses attached to the water-soluble organic solvent are the SP value [unit: $(J/cm^3)^{1/2}$] obtained by the Fedors method. "Acetylenol E100" is the trade name of a surfactant manufactured by Kawaken Fine Chemicals Co., Ltd.

TABLE 3-1

| Composition and properties of cleaning liquid | Cleaning Liquid | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| Glycerin (33.5) | | | | | | | | | | | | | |
| Diethylene glycol (30.6) | | | | | | | | | | | | | |
| 1,5-pentanediol (29.0) | | | | | | 30.0 | | | | | | | |
| Triethylene glycol (27.8) | | | | | | | 30.0 | | | | | | |
| 3-methyl-1,5-pentanediol (27.4) | | | | | | | | 30.0 | | | | | |
| 2-methylpentane-2,4-diol (26.8) | | | | | | | | | 30.0 | | | | |
| 1,2-butanediol (26.1) | | | | 15.0 | | | | | | 30.0 | | | |
| 2-pyrrolidone (25.9) | | | | | | | | | | | 30.0 | | |
| 1,2-pentanediol (25.0) | | | | | | | | | | | | 30.0 | |
| 1,2-hexanediol (24.1) | 30.0 | 30.0 | 30.0 | 15.0 | 15.0 | | | | | | | | |
| N-methyl-2-pyrrolidone (23.6) | | | | | | | | | | | | | 30.0 |
| Diethylene glycol monoethyl ether (22.4) | | | | | | | | | | | | | |
| Diethylene glycol monobutyl ether (21.5) | | | | | | | | | | | | | |
| 3-methoxy-3-methylbutanol (21.5) | | | | | 15.0 | | | | | | | | |
| Diethylene glycol isobutyl ether (21.2) | | | | | | | | | | | | | |
| Triethylene glycol monobutyl ether (21.1) | | | | | | | | | | | | | |
| Polyethylene glycol 1,000 (20.7) | | | | | | | | | | | | | |
| Tetraethylene glycol dimethyl ether (17.5) | | | | | | | | | | | | | |
| Triethylene glycol butyl methyl ether (17.2) | | | | | | | | | | | | | |
| Ethylene glycol dimethyl ether (15.6) | | | | | | | | | | | | | |

TABLE 3-1-continued

| Composition and properties of cleaning liquid | | | | | | | | | | | | | |
|---|---|---|---|---|---|---|---|---|---|---|---|---|---|
| | Cleaning Liquid | | | | | | | | | | | | |
| | 1 | 2 | 3 | 4 | 5 | 6 | 7 | 8 | 9 | 10 | 11 | 12 | 13 |
| Acetylenol E100 | | 1.0 | | | | | | | | | | | |
| N,N-dimethyldodecylamine-N-oxide | | | 1.0 | | | | | | | | | | |
| Sodium oleate | | | | | | | | | | | | | |
| Ion exchange water | 70.0 | 69.0 | 69.0 | 70.0 | 70.0 | 70.0 | 70.0 | 70.0 | 70.0 | 70.0 | 70.0 | 70.0 | 70.0 |
| Content of first solvent (%) | 30.0 | 30.0 | 30.0 | 30.0 | 30.0 | 30.0 | 30.0 | 30.0 | 30.0 | 30.0 | 30.0 | 30.0 | 30.0 |

TABLE 3-2

| Composition and properties of cleaning liquid | | | | | | | | | | | | | |
|---|---|---|---|---|---|---|---|---|---|---|---|---|---|
| | Cleaning Liquid | | | | | | | | | | | | |
| | 14 | 15 | 16 | 17 | 18 | 19 | 20 | 21 | 22 | 23 | 24 | 25 | 26 |
| Glycerin (33.5) | | | | | | | | | | | | | 15.0 |
| Diethylene glycol (30.6) | | | | | | | | | | | | | |
| 1,5-pentanediol (29.0) | | | | | | | | | | | | | |
| Triethylene glycol (27.8) | | | | | | | | | | | | | |
| 3-methyl-1,5-pentanediol (27.4) | | | | | | | | | | | | | |
| 2-methylpentane-2,4-diol (26.8) | | | | | | | | | | | | | |
| 1,2-butanediol (26.1) | | | | | | | | | | | | | |
| 2-pyrrolidone (25.9) | | | | | | | | | | | | | |
| 1,2-pentanediol (25.0) | | | | | | | | | | | | | |
| 1,2-hexanediol (24.1) | | | | | | | | | 15.0 | 20.0 | 40.0 | 45.0 | 30.0 |
| N-methyl-2-pyrrolidone (23.6) | | | | | | | | | | | | | |
| Diethylene glycol monoethyl ether (22.4) | 30.0 | | | | | | | | | | | | |
| Diethylene glycol monobutyl ether (21.5) | | 30.0 | | | | | | | | | | | |
| 3-methoxy-3-methylbutanol (21.5) | | | 30.0 | | | | | | | | | | |
| Diethylene glycol isobutyl ether (21.2) | | | | 30.0 | | | | | | | | | |
| Triethylene glycol monobutyl ether (21.1) | | | | | 30.0 | | | | | | | | |
| Polyethylene glycol 1,000 (20.7) | | | | | | 30.0 | | | | | | | |
| Tetraethylene glycol dimethyl ether (17.5) | | | | | | | 30.0 | | | | | | |
| Triethylene glycol butyl methyl ether (17.2) | | | | | | | | 30.0 | | | | | |
| Ethylene glycol dimethyl ether (15.6) | | | | | | | | | | | | | |
| Acetylenol E100 | | | | | | | | | | | | | |
| N,N-dimethyldodecylamine-N-oxide | | | | | | | | | | | | | |
| Sodium oleate | | | | | | | | | | | | | |
| Ion exchange water | 70.0 | 70.0 | 70.0 | 70.0 | 70.0 | 70.0 | 70.0 | 70.0 | 85.0 | 80.0 | 60.0 | 55.0 | 55.0 |
| Content of first solvent (%) | 30.0 | 30.0 | 30.0 | 30.0 | 30.0 | 30.0 | 30.0 | 30.0 | 15.0 | 20.0 | 40.0 | 45.0 | 30.0 |

TABLE 3-3

| Composition and properties of cleaning liquid | | | | | | | | | | | | |
|---|---|---|---|---|---|---|---|---|---|---|---|---|
| | Cleaning Liquid | | | | | | | | | | | |
| | 27 | 28 | 29 | 30 | 31 | 32 | 33 | 34 | 35 | 36 | 37 | 38 |
| Glycerin (33.5) | | | | | | | | | 30.0 | 30.0 | 75.0 | 20.0 |
| Diethylene glycol (30.6) | | | | | | 30.0 | | | | | | 10.0 |
| 1,5-pentanediol (29.0) | | | | | | | | | | | | |

TABLE 3-3-continued

| Composition and properties of cleaning liquid | | | | | | | | | | | | |
|---|---|---|---|---|---|---|---|---|---|---|---|---|
| | Cleaning Liquid | | | | | | | | | | | |
| | 27 | 28 | 29 | 30 | 31 | 32 | 33 | 34 | 35 | 36 | 37 | 38 |
| Triethylene glycol (27.8) | | | 8.0 | | | | | | | | | |
| 3-methyl-1,5-pentanediol (27.4) | | | | | | | | | | | | |
| 2-methylpentane-2,4-diol (26.8) | | | | | | | | | | | | |
| 1,2-butanediol (26.1) | | | | | | | | | | | | |
| 2-pyrrolidone (25.9) | | | | 5.0 | 45.0 | | | | | | | |
| 1,2-pentanediol (25.0) | | | | | | | | | | | | |
| 1,2-hexanediol (24.1) | 50.0 | | | | | | | | | | | |
| N-methyl-2-pyrrolidone (23.6) | | | | | | | | | | | | |
| Diethylene glycol monoethyl ether (22.4) | | | | | | | | | | | | |
| Diethylene glycol monobutyl ether (21.5) | | 25.0 | 12.0 | | | | | | | | | |
| 3-methoxy-3-methylbutanol (21.5) | | | | | | | | | | | | |
| Diethylene glycol isobutyl ether (21.2) | | | | | | | | | | | | |
| Triethylene glycol monobutyl ether (21.1) | | | | | | | | | | | | |
| Polyethylene glycol 1,000 (20.7) | | | | | | | | | | | | |
| Tetraethylene glycol dimethyl ether (17.5) | | | | | | | | | | | | |
| Triethylene glycol butyl methyl ether (17.2) | | | | | | | | | | | | |
| Ethylene glycol dimethyl ether (15.6) | | | | | | | 30.0 | | | | | |
| Acetylenol E100 | | | | | | | | | | 1.0 | | 1.0 |
| N,N-dimethyldodecylamine-N-oxide | | | | | | | | | | | | |
| Sodium oleate | | 1.0 | | | | | | | | | | |
| Ion exchange water | 50.0 | 74.0 | 80.0 | 95.0 | 55.0 | 70.0 | 70.0 | 100.0 | 70.0 | 69.0 | 25.0 | 69.0 |
| Content of first solvent (%) | 50.0 | 25.0 | 20.0 | 5.0 | 45.0 | 0.0 | 0.0 | 0.0 | 0.0 | 0.0 | 0.0 | 0.0 |

<Production of Porous Body>

Emulsion polymerized particles of crystallized fluorine resin (polytetrafluoroethylene) were compression molded and then stretched at a temperature of a melting point or less to prepare a fibrillated porous layer (first layer). Further, polyethylene and polypropylene were mixed and then stretched by a wetting method to prepare a fibrillated porous layer (second layer). In addition, a polyolefin-based nonwoven fabric (trade name "HOP60", manufactured by Hirose Paper Co., Ltd.) was used as a third layer. The thickness of the second layer is larger than that of the first layer. In addition, the average pore size of the second layer is smaller than that of the first layer. The first layer, the second layer and the third layer were subjected to hot pressure lamination to adhere to each other to obtain the porous body.

<Evaluation>

The cleaning liquid, the ink and the reaction liquid were the combinations shown on the left side of Tables 4-1 and 4-2. The combinations are charged into the cleaning member 109, the ink applying device 104 and the reaction liquid applying device 103 of the transfer type ink jet recording apparatus 100 having the configuration shown in FIGURE. The configuration of the transfer type ink jet recording apparatus 100 used is as follows. A cylindrical drum formed of an aluminum alloy was used as the support member 102. The surface layer member (surface layer containing a siloxane compound) of the transfer body 101 was manufactured by the following procedure.

By mixing 50 mol % of a hydrolyzable organosilane compound (diethyldiethoxysilane, manufactured by Shin-Etsu Chemical Co., Ltd.) and 50 mol % of an organosilane compound (diethyldiethoxysilane, Shin-Etsu Chemical Co., Ltd.), a mixture was obtained. Water and acetic acid (catalyst) were added to the obtained mixture. The acetic acid was added so as to be 500 ppm with respect to the total mass. Thereafter, the heating reflux was performed for 24 hours or more to obtain a solution which contains a condensation compound formed by performing dehydration condensation on an organic silane compound. The solution was diluted to 27% by adding a mixed solvent of ethanol and methyl isobutyl ketone (mass ratio 4:1). In addition, a photo cationic polymerization initiator (trade name "CPI-410S" manufactured by San-Apro Co., Ltd.) was added in an amount of 3 mol % with respect to the solid content to prepare a coating liquid.

A substrate of the transfer body in which a polyethylene terephthalate film having a thickness of 0.05 mm is coated at a thickness of 0.2 mm with silicone rubber having a rubber hardness of 40 degrees was prepared. The prepared substrate was coated with the prepared coating liquid by spin coating to provide a thin film-shaped surface layer on the surface of the substrate. The substrate was exposed by a UV lamp and then heated at 120° C. for 2 hours to harden the surface layer. In this way, the transfer body 101 having the layer formed by the resin having the siloxane structure was obtained. The obtained transfer body 101 was fixed to the support member 102 by using a double-sided adhesive tape.

The reaction solution was applied onto the transfer body 101 by the reaction liquid applying device 103 to have a concentration of 1.0 g/m$^2$. The recording head of a type in which ink is ejected by an on-demand system having an electrothermal transducing element was used as the ink applying device 104, and the ink was applied to the region of the transfer body 101, the region being applied with the reaction liquid.

The above-mentioned porous body was used as the liquid absorbing member 105*a*. The moving speed of the liquid absorbing member 105*a* was adjusted by controlling the rotation speed of the extending roller 105*c* to be equal to the rotation speed of the transfer body 101. The moving speed of the liquid absorbing member 105*a* was set to be 0.4 m/sec. The liquid absorbing member 105*a* was immersed in a liquid containing 95.0 parts of ethanol and 5.0 parts of water to permeate the liquid into the voids of the porous body, and then the inside in the voids was substituted with water to be used for the liquid removal. A pressure was applied to the pressing member 105*b* so that the nip pressure (average pressure) between the transfer body 101 and the liquid absorbing member 105*a* was 2 kg/cm$^2$.

The recording medium 108 was conveyed by driving the recording medium feeding roller 107*a* and the recording medium winding roller 107*b* so that the speed thereof was equal to the rotation speed of the transfer body 101. The recording medium 108 and the intermediate image come into contact with each other between the transfer body 101 and the pressing member 106 to transfer the intermediate image from the transfer body 101 onto the recording medium 108, thereby recording the solid image. The coated paper (trade name "Aurora Coat", manufactured by NIPPON PAPER INDUSTRIES CO., LTD., a basis weight of 104 g/m$^2$) was used as the recording medium 108. The nip pressure between the transfer body 101 and the pressing member 106 was adjusted to be 3 kg/cm$^2$.

The cleaning member 109 supplied with the cleaning liquid supplied from the cleaning liquid container (not shown) applied the cleaning liquid to the transfer body 101. Thereafter, the cleaning liquid was removed from the transfer body 101 using the cleaning liquid removing member 110. As the cleaning liquid removing member 110, the same material as the produced porous body was used.

A solid image of 5 cm×5 cm having a recording duty of 10% was recorded on a total of 1,000 recording mediums by using the transfer type ink jet recording apparatus 100 having the above configuration. In the transfer type ink jet recording apparatus 100, the image recorded under the condition that 3.0 ng of ink droplet is applied to a unit area of 1/1200 inch×1/1200 by one drop is defined as a recording duty of 100%. It was evaluated whether the dot defects and the white spots on the image are suppressed according to the following shown evaluation criteria by observing, by a microscope, the dot defects and the white spots on the image recorded on a 10$^{th}$ recording medium, a 500$^{th}$ recording medium and a 1000$^{th}$ recording medium, respectively. It can be said that the cleaning liquid is good as long as both of the dot defects and the white spots of the image are suppressed. In Examples 30, 40 and 41, the reaction liquid applying step was not performed. In addition, in Example 37, the step of removing the cleaning liquid on the transfer body was performed after the cleaning step, after the cleaning step. In the present invention, in the evaluation criteria of each of the following items, "AA", "A" and "B" were defined as the acceptable level, and "C" was defined as an unacceptable level. The evaluation results are shown in Tables 4-1 and 4-2.

[Evaluation Criteria for Suppression of Dot Defect on Image]

AA: There was no dot defect on the 1000$^{th}$ image

A: Although there was no dot defect on the 500$^{th}$ image, the dot defect occurred in the 1000$^{th}$ image B: Although there was no dot defect on the 10$^{th}$ image, the dot defect occurred on the 500$^{th}$ image C: The dot defect occurred on the 10$^{th}$ image.

[Evaluation Criteria for Suppression of White Spot on Image]

AA: There was no white spot on the 1000$^{th}$ image

A: Although there was no white spot on the 500$^{th}$ image, the white spot occurred in the 1000$^{th}$ image B: Although there was no white spot on the 10$^{th}$ image, the white spot occurred on the 500$^{th}$ image C: The white spot occurred on the 10$^{th}$ image

TABLE 4-1

Evaluation condition, evaluation results

| | | Evaluation Condition | | | Evaluation Result | |
|---|---|---|---|---|---|---|
| | | Cleaning Liquid | Ink | Reaction Liquid | Suppression of dot defect | Suppression of white spot |
| Example | 1 | 1 | 1 | 1 | AA | AA |
| | 2 | 1 | 2 | 1 | AA | AA |
| | 3 | 1 | 3 | 1 | AA | AA |
| | 4 | 1 | 4 | 1 | AA | AA |
| | 5 | 1 | 5 | 1 | AA | AA |
| | 6 | 1 | 6 | 1 | AA | AA |
| | 7 | 1 | 1 | 2 | AA | AA |
| | 8 | 1 | 7 | 3 | A | AA |
| | 9 | 1 | 1 | 3 | AA | AA |
| | 10 | 2 | 1 | 1 | AA | AA |
| | 11 | 3 | 1 | 1 | AA | AA |
| | 12 | 4 | 1 | 1 | AA | AA |
| | 13 | 5 | 1 | 1 | AA | AA |
| | 14 | 6 | 1 | 1 | A | AA |
| | 15 | 7 | 1 | 1 | B | A |
| | 16 | 8 | 1 | 1 | A | AA |
| | 17 | 9 | 1 | 1 | A | AA |
| | 18 | 10 | 1 | 1 | AA | AA |
| | 19 | 11 | 1 | 1 | B | A |
| | 20 | 12 | 1 | 1 | AA | AA |
| | 21 | 13 | 1 | 1 | B | A |
| | 22 | 14 | 1 | 1 | A | A |
| | 23 | 15 | 1 | 1 | A | A |
| | 24 | 16 | 1 | 1 | A | AA |
| | 25 | 17 | 1 | 1 | A | A |
| | 26 | 18 | 1 | 1 | A | A |
| | 27 | 19 | 1 | 1 | B | A |
| | 28 | 20 | 1 | 1 | A | A |
| | 29 | 21 | 1 | 1 | A | A |
| | 30 | 1 | 1 | — | B | A |
| | 31 | 22 | 1 | 1 | B | B |
| | 32 | 23 | 1 | 1 | AA | AA |
| | 33 | 24 | 1 | 1 | AA | AA |
| | 34 | 25 | 1 | 1 | B | B |
| | 35 | 26 | 1 | 1 | B | B |
| | 36 | 27 | 1 | 1 | B | B |
| | 37 | 1 | 1 | 1 | AA | AA |
| | 38 | 28 | 1 | 1 | A | A |
| | 39 | 29 | 1 | 1 | A | A |
| | 40 | 30 | 1 | — | B | B |
| | 41 | 31 | 1 | — | B | B |

TABLE 4-2

| Evaluation condition, evaluation results | | | | | | |
|---|---|---|---|---|---|---|
| | | Evaluation Condition | | | Evaluation Result | |
| | | Cleaning Liquid | Ink | Reaction Liquid | Suppression of dot defect | Suppression of white spot |
| Reference Example | 1 | 1 | 7 | 1 | AA | AA |
| | 2 | 32 | 7 | 1 | AA | AA |
| | 3 | 33 | 7 | 1 | AA | AA |
| | 4 | 34 | 7 | 1 | AA | AA |
| Comparative Example | 1 | — | 1 | 1 | C | C |
| | 2 | 35 | 1 | 1 | C | C |
| | 3 | 32 | 1 | 1 | C | C |
| | 4 | 33 | 1 | 1 | C | C |
| | 5 | 36 | 1 | 1 | C | C |
| | 6 | 37 | 1 | 1 | C | C |
| | 7 | 36 | 1 | 1 | C | C |
| | 8 | 34 | 1 | 1 | C | C |
| | 9 | 38 | 1 | 1 | C | C |

In Example 37 in which the step of removing the cleaning liquid was performed, the liquid residues were reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-137620, filed Jul. 14, 2017, and Japanese Patent Application No. 2018-115730, filed Jun. 19, 2018, which are hereby incorporated by reference herein in their entirety.

What is claimed is:

1. An ink jet recording method for recording an image on a recording medium using an aqueous ink, the method comprising in the following order:

(a) forming an intermediate image by applying the aqueous ink to a transfer body;

(b) transferring the intermediate image by bringing the intermediate image into contact with the recording medium; and (c) cleaning the transfer body by applying an aqueous cleaning liquid to the transfer body, and if necessary, further comprising applying an aqueous reaction liquid comprising a reactant that reacts with the aqueous ink to the transfer body, wherein at least one of the aqueous ink and the reaction liquid comprises a resin particle (however, when not including the applying of the reaction liquid, the aqueous ink comprises the resin particle), and wherein the cleaning liquid comprises a first water-soluble organic solvent having an SP value [unit: $(J/cm^3)^{1/2}$], which is obtained by a Fedors method, of 17.0 or more to 29.0 or less.

2. The ink jet recording method of claim 1, wherein the applying of the reaction liquid is performed before the forming of the intermediate image.

3. The ink jet recording method of claim 2, wherein the applying of the reaction liquid is performed with a roller.

4. The ink jet recording method of claim 1, wherein the content (% by mass) of the first water-soluble organic solvent in the cleaning liquid is 20.0% by mass or more to 40.0% by mass or less with respect to the total mass of the cleaning liquid, and the content (% by mass) of water in the cleaning liquid is 60.0% by mass or more with respect to the total mass of the cleaning liquid.

5. The ink jet recording method of claim 1, wherein the first water-soluble organic solvent is at least one of monohydric alcohol, dihydric alcohol and glycol ether.

6. The ink jet recording method of claim 1, wherein the first water-soluble organic solvent is at least one of monohydric alcohol and dihydric alcohol.

7. The ink jet recording method of claim 1, wherein the first water-soluble organic solvent is at least one selected from the group consisting of 1,2-butanediol, 1,2-pentanediol and 1,2-hexanediol.

8. The ink jet recording method of claim 1, further comprising removing the cleaning liquid on the transfer body after the cleaning.

9. The ink jet recording method of claim 8, wherein the removing of the cleaning liquid is performed with an absorber.

10. The ink jet recording method of claim 1, wherein the first water-soluble organic solvent is 1,2-hexanediol.

11. The ink jet recording method of claim 1, wherein the cleaning of the transfer body is performed with a cleaning member having a roller form.

12. An ink jet recording apparatus for recording an image on a recording medium using an aqueous ink, the apparatus comprising:

(a) an ink applying unit that ejects the aqueous ink by an ink jet system and applies the aqueous ink to a transfer body to form an intermediate image;

(b) a transfer unit that transfers the intermediate image by bringing the intermediate image into contact with the recording medium; and (c) a cleaning unit that applies an aqueous cleaning liquid to the transfer body to clean the transfer body, and if necessary, further comprising a reaction liquid applying unit that applies an aqueous reaction liquid comprising a reactant that reacts with the aqueous ink to the transfer body, wherein at least one of the aqueous ink and the reaction liquid comprises a resin particle (however, when not including the reaction liquid applying unit, the aqueous ink comprises the resin particle), and wherein the cleaning liquid comprises a first water-soluble organic solvent having an SP value [unit: $(J/cm^3)^{1/2}$], which is obtained by a Fedors method, of 17.0 or more to 29.0 or less.

* * * * *